US007540337B2

(12) United States Patent
McLoughlin et al.

(10) Patent No.: US 7,540,337 B2
(45) Date of Patent: Jun. 2, 2009

(54) ADAPTIVE APPARATUS, SYSTEM AND METHOD FOR COMMUNICATING WITH A DOWNHOLE DEVICE

(76) Inventors: Stephen John McLoughlin, 10 Pygmalionos Street, Limassol (CY) 4521; Feroze Michael Variava, 10 Theofilou Georgiacdi Street New Ekali, Limassol (CY) 3111

( * ) Notice: Subject to any disclaimer, the term of this patent is extended or adjusted under 35 U.S.C. 154(b) by 318 days.

(21) Appl. No.: 11/528,162

(22) Filed: Sep. 27, 2006

(65) Prior Publication Data

US 2008/0000688 A1 Jan. 3, 2008

Related U.S. Application Data

(60) Provisional application No. 60/818,435, filed on Jul. 3, 2006.

(51) Int. Cl.
*E21B 7/08* (2006.01)
*H04H 9/00* (2006.01)

(52) U.S. Cl. ..... 175/45; 367/83

(58) Field of Classification Search ..... 175/40, 175/45, 48; 367/83; 340/854.3, 854.4
See application file for complete search history.

(56) References Cited

U.S. PATENT DOCUMENTS 4,078,620 A * 3/1978 Westlake et al. ..... 175/48
4,734,892 A * 3/1988 Kotlyar ..... 367/83
4,763,258 A 8/1988 Engelder
5,507,353 A 4/1996 Pavone
5,979,570 A 11/1999 McLoughlin et al.
6,065,332 A 5/2000 Dominick
6,267,185 B1 7/2001 Mougel
6,608,565 B1 8/2003 van Steenwyck
6,651,496 B2 11/2003 van Steenwyck
6,732,052 B2 5/2004 MacDonald
6,808,027 B2 10/2004 McLoughlin et al.
6,847,304 B1 1/2005 McLoughlin
2007/0189119 A1* 8/2007 Klotz et al. ..... 367/83

FOREIGN PATENT DOCUMENTS

GB 2352743 2/2001

* cited by examiner

*Primary Examiner*—William P Neuder
(74) *Attorney, Agent, or Firm*—C. W. Alworth

(57) ABSTRACT

A system, apparatus and method for adaptive communication with a downhole device is disclosed. The instant invention proposes an adaptive system of communicating information from the surface of the earth to a device located downhole; thereby optimizing the drilling process by adaptively fitting the talkdown protocol around the existing drillstring RPM. A further economic benefit is that with this adaptive system the ΔRPM Offset between the optimized drilling condition and the RPM required for data transmission can be monitored and adjusted in real-time, resulting in less disruption to the drilling process. Several embodiments are given.

37 Claims, 6 Drawing Sheets

FIGURE 1
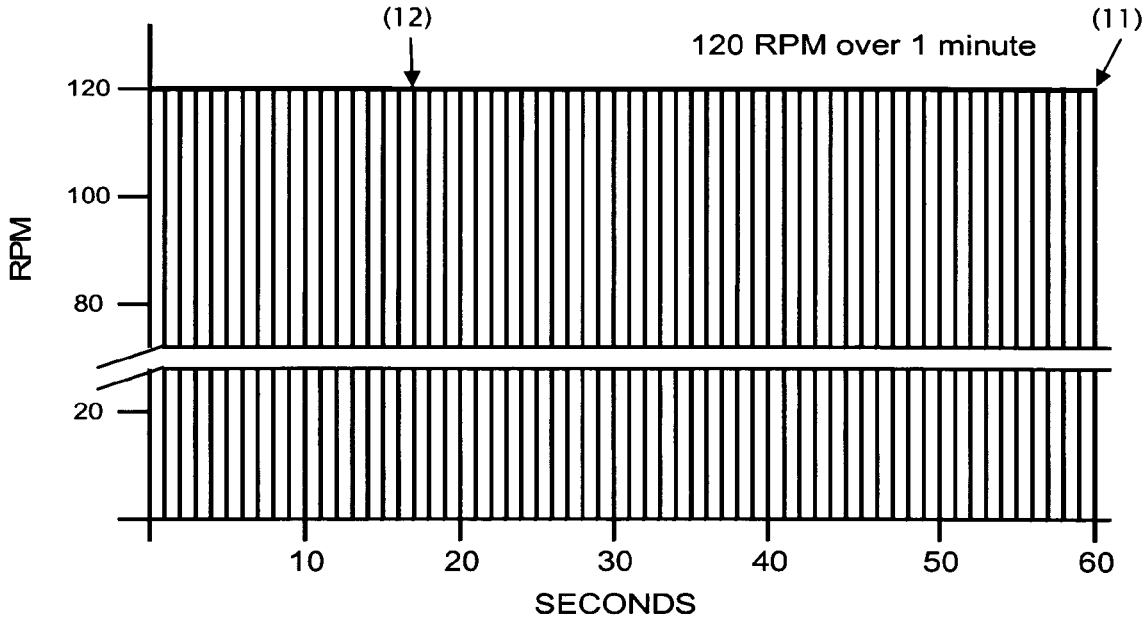
FIGURE 2 - RPM in 1 Minute (Uneven)
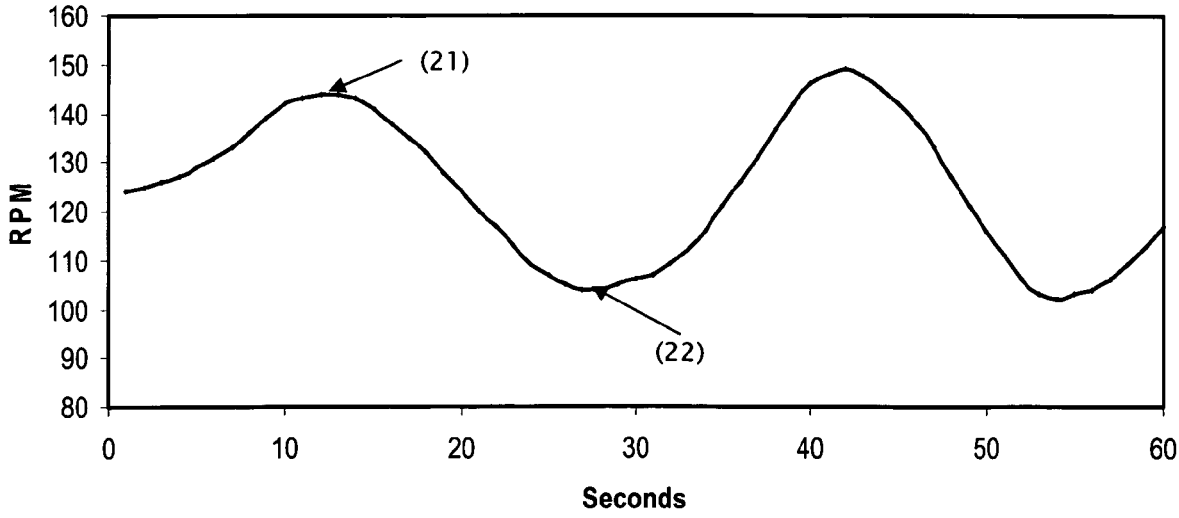

(32)
(33)
(30)
(34)
(35)
(35)
(31)
180
160
140
120
100
80
60
40
20
R
P
M
10
20
30
40
50
60
SECONDS

(41)
(45)
(42)
(44)
(40) Baseline RPM
(43)
(46)

RAMP MITIGATION

Prior to rotation. Return to zero at end of set $n^2$ and $n^3$ transmission compromised by proximity.

FIG. 9A

| $n^1$ | | | | $n^2$ | | | | $n^3$ | | | |
|---|---|---|---|---|---|---|---|---|---|---|---|
| 0 | 1 | 2 | 3 | 16 | 32 | 48 | 64 | 272 | 528 | 784 | 1040 |
| 4 | 5 | 6 | 7 | 80 | 96 | 112 | 128 | 1296 | 1552 | 1808 | 2064 |
| 8 | 9 | 10 | 11 | 144 | 160 | 176 | 192 | 2320 | 2576 | 2832 | 3088 |
| 12 | 13 | 14 | 15 | 208 | 224 | 240 | 256 | 3344 | 3600 | 3856 | 4112 |

(91)

$t^1$ $t^2$ $t^3$ $t^4$ $t^5$ $t^6$

Center data set rotated clockwise. Return to zero at end of each set. $n^2$ and $n^3$ still compromised.

FIG. 9B

| $n^1$ | | | | $n^2$ CW | | | | $n^3$ | | | |
|---|---|---|---|---|---|---|---|---|---|---|---|
| 0 | 1 | 2 | 3 | 208 | 144 | 80 | 16 | 272 | 528 | 784 | 1040 |
| 4 | 5 | 6 | 7 | 224 | 160 | 96 | 32 | 1296 | 1552 | 1808 | 2064 |
| 8 | 9 | 10 | 11 | 240 | 176 | 112 | 48 | 2320 | 2576 | 2832 | 3088 |
| 12 | 13 | 14 | 15 | 256 | 192 | 128 | 64 | 3344 | 3600 | 3856 | 4112 |

$t^1$ $t^2$ $t^3$ $t^4$ $t^5$ $t^6$

Center data set rotated counter-clockwise. Return to zero at end of each set. Clear definition.

FIG. 9C

| $n^1$ | | | | $n^2$ ACW | | | | $n^3$ | | | |
|---|---|---|---|---|---|---|---|---|---|---|---|
| 0 | 1 | 2 | 3 | 64 | 128 | 192 | 256 | 272 | 528 | 784 | 1040 |
| 4 | 5 | 6 | 7 | 48 | 112 | 176 | 240 | 1296 | 1552 | 1808 | 2064 |
| 8 | 9 | 10 | 11 | 32 | 96 | 160 | 224 | 2320 | 2576 | 2832 | 3088 |
| 12 | 13 | 14 | 15 | 16 | 80 | 144 | 208 | 3344 | 3600 | 3856 | 4112 |

$t^1$ $t^2$ $t^3$ $t^4$ $t^5$ $t^6$

FIGURE 9

ADAPTIVE APPARATUS, SYSTEM AND METHOD FOR COMMUNICATING WITH A DOWNHOLE DEVICE

This application claims priority from U.S. Provisional Application Ser. No. 60/818,435 filed on 3 Jul. 2006.

TECHNICAL FIELD OF THE INVENTION

This invention relates to the drilling industry and in particular to an apparatus, system and method of communicating with a downhole tool assembly.

BACKGROUND OF THE INVENTION

In the field of drilling it is frequently desirable to communicate with devices which are located at the downhole end of the drilling assembly. There are few variable parameters which are readily transferable from the surface to the downhole location or assembly and all of these suffer from shortcomings. Largely, the measurable variables in the drilling operation are; the flow of fluids through the drillstring, the amount of weight which is placed on the bit and the revolutions of the drillpipe.

This disclosure acknowledges that weight on bit and fluid cycling are limited in their range of data transmission as, inevitably, they are confined to being binary input parameters. These surface variable parameters can have a negative impact upon the drilling operation when used as means of communicating with downhole devices, as; either the transmission time is lengthened which serves to interrupt the process of drilling the well or the data to be transmitted is, of necessity, reduced in content.

Previous attempts to communicate via drillstring RPM were successful but compromised the efficiency of the drilling operation in that the frequencies of operation were recurrently related to a baseline of zero RPM. In rotary drilling zero RPM equates to a non-drilling state, in other words, in order to be able to communicate using RPM the drilling operation had to be arrested, resulting in poorer drilling productivity and less rewarding economics. The essence of the instant invention is that it allows the baseline incremental drillstring RPM to be established and then increases or decreases RPM transmission in order to create a carrier for the desired data to be transmitted, without arresting the drilling operation. Expressed differently the instant invention uses the nominal drillstring RPM to establish itself as a carrier and then deviates from this established norm by marginal amounts. Assuming that the nominal RPM has been established in order to optimize drilling efficiency, the instant method and apparatus thus represents the best opportunity for adaptive downlink telemetry with the least interference to optimized drilling parameters. Yet a further benefit of the invention is the amount of data which may be transmitted in a timely manner from the surface of the earth to a downhole device or devices located at the distal end of the drilling assembly.

It is an axiom of rotary drilling that if a single revolution of the drillstring is input at the surface then it must be transmitted to the bit. Failure of the revolution to "transit" to the bit means either a "back-off" (the drillstring unscrewed) or a "twist-off" (the drillstring broke in two).

In the past, the reason for the use of zero RPM as a marker is that it has a definitive null value, either of vibration, rotation or rate of rotation and is therefore an easily measurable state.

Prior art [ENGELDER, U.S. Pat. No. 4,763,258] METHOD AND APPARATUS FOR TELEMETRY WHILE DRILLING BY CHANGING DRILLSTRING ROTATION ANGLE OR SPEED contemplated the use of solid state sensors which monitored "angularly dependent geophysical parameters while rotating the drillstring" in order to communicate from the surface to the downhole device. Magnetometers and inclinometers were sampled and signals therefrom were conditioned, multiplexed, converted to digital signals and then processed. By alternating the RPM with zero RPM bands and by altering the RPM ranges, information could be communicated to the downhole device. The device was limited in that the processing power and sensor sample frequency which was available at that time was much slower than that which is available at the present time. The device required slow rotation of the drillstring in order to communicate from the surface of the wellbore to the downhole device. Although this methodology is feasible, the length of the drillstring, directional characteristics of the wellbore and physical attributes of the drillstring are all variables which will all affect the ability to accurately transfer information to the distal end of the drilling assembly, or, more specifically, to determine with any degree of accuracy, the 'arrival-time' of the information at the distal end of the drilling assembly. A further difficulty with this particular arrangement, as previously explored, is the requirement to stop the drilling process, which, in practice, necessitates lifting the bit from the bottom-of the wellbore resulting in additional lost productive time. This is particularly required when drilling using aggressive, high torque, PDC bits, due to the resultant amount of on-bottom torsional friction which is created.

More recent prior art [MOUGEL AND HUTIN G.B. 2,352,743, U.S. Pat. No. 6,267,185] APPARATUS AND METHOD FOR COMMUNICATION WITH DOWNHOLE EQUIPMENT USING DRILLSTRING ROTATION AND GYROSCOPIC SENSORS removed the requirement for the measurement of geophysical parameters, substituting the measurement of non-geophysical parameters in the form of inertial rate gyroscopes. This, later art, taking advantage of faster downhole processor times, also claimed the possibility of both binary and decimal communication modes. The removal of dependent geophysical parameters would be of particular use when communications with downhole devices are planned in a zone of magnetic interference or in operational usage where there are unpredictable results from conventional geomagnetic sensors such as in surface conductor drilling beneath offshore platforms.

Additional prior art [van STEENWYCK et al. U.S. Pat. No. 6,608,565] DOWNWARD COMMUNICATION IN A BOREHOLE THROUGH DRILLSTRING ROTARY MODULATION concluded that additional transmitted data density could be achieved by modulating RPM either between a base level of zero RPM and a certain pre-determined value of RPM or, alternately, by eliminating the zero RPM baseline indicator, between two pre-determined values of RPM, which would potentially allow drilling to continue during drillstring rotary modulation.

U.S. Pat. No. 6,608,565 [van STEENWYCK et al.] proposes that two levels of modulation input are utilized to create "talkdown" waveforms. Talkdown is essentially a phrase describing information passed down to the distal end of the drillstring—"talkdown." Relative pre-determined discrete rotation rates, (R1, R2) ("RPM") are measured downhole against time and the default device for talkdown is described as an MWD device. This invention, applies a well understood measurement-while drilling ("MWD") form of binary encoding technique and methodology to the transmission of data from surface to downhole.

The specification provides illustration and constraint on the method in FIG. 1 and FIG. 10, while the methodology of signal conditioning, processing and threshold identification and message capture of the downhole device is illustrated in FIGS. 5 through 7.

The data is preceded by a "sync" word consisting of a pulse width with a rising edge, corresponding to an increase in RPM, a pulse of equal width which corresponds to a decrease in RPM with a message word which consists of two periods of increased RPM, with a single band of lower RPM between. This format is considered to constitute optimal transmission methodology with minimal disruption to the drillstring.

In the field of drilling and in particular directional drilling, there is found a phenomenon known as "stick-slip" which is caused by a variety of friction factors of the drillstring rotating within the borehole. "Stick-slip causes the tubulars which comprise the drilling assembly (drillstring) to react like a coiled spring—winding up and unwinding: the degree and severity of the acceleration and deceleration of the drillstring, when compared with a nominal baseline RPM determines the classification of the qualitative condition which can be largely described as being anything from "mild" to "severe." "Stick-slip" of whatever nature is not a desirable by-product, either from the perspective of drilling dynamics and efficiency, nor from the negative affect which it has on drilling tools which are located in the lower component of the BHA.

Historically, it is evident that stick-slip is an element which is difficult to quantify. It is almost impossible to avoid or eradicate during normal rotary drilling. It is the intention of this disclosure to introduce a system which is capable of surface power input management which may serve to reduce some of the peak accelerations which are observed at the distal end of the drillstring. The effectiveness of this invention may be improved particularly if the drillstring surface power management control system is augmented by selected data indicating the real-time status of downhole rotary conditions and which is transmitted in a recognizable format from the downhole to the surface location. It is a goal of this invention to enable a reduction of and, dependent upon the severity of the borehole condition, potentially to eliminate stick-slip.

Stick-slip constituted a further constraint in the entire prior art examples. The complexity of stick-slip is such that any of the following may have an effect on the magnitude of stick-slip: borehole inclination, hole-diameter, drillpipe diameter, BHA length and component configuration, bit type, bit gauge, bit cutter types, formation type, formation bedding planes and drilling fluids. Stick-slip is most noticeable during drilling, i.e. has a comparatively low magnitude when rotating off bottom and it is the interaction of bit with the formation which apparently contributes heavily to the largest element of stick-slip.

Van Steenwyck, in 2003 [U.S. Pat. No. 6,651,496], "INERTIALLY STABILIZED MAGNETOMETER MEASURING APPARATUS FOR USE IN A BOREHOLE ROTARY ENVIRONMENT", proposes a device for reducing the effect of stick-slip on instruments which are rotationally co-located within a drillstring. (Ibid. FIGS. 1(*a*) through 1(*d*) and provide diagrammatic examples of the influence of stick-slip on sensor output for sensors which are co-located within a collar mechanism which is being subjected to stick-slip forces.

[McLOUGHLIN, U.S. Pat. No. 6,847,304] "APPARATUS AND METHOD FOR TRANSMITTING INFORMATION TO AND COMMUNICATING WITH A DOWNHOLE DEVICE, proposed the superimposition of magnetic field(s) over the prevailing geomagnetic field, and constructed a means of transferring signal from surface, via the rotating drillstring, to a downhole electromechanical sub-assembly which incorporated a non-rotating portion as a component of a three-dimensional rotary steerable drilling device.

Acknowledging and utilizing the increases in downhole electronic sampling and processing power which had occurred since the ENGELDER Patent, McLoughlin proposed a frequency modulated approach to data transmission. During the prototyping phase of the downhole device explained in U.S. Pat. No. 5,979,570 to McLoughlin et al, SURFACE CONTROLLED WELLBORE DIRECTIONAL STEERING TOOL, industry professionals expressed concern that the communications methodology which is described in U.S. Pat. No. 6,847,304 to MCLOUGHLIN would be ineffective when communicating with a device located at the distal end of the drilling assembly.

Apocryphal reasons for this belief centered around drillstring properties; PAVONE, U.S. Pat. No. 5,507,353 METHOD AND SYSTEM FOR CONTROLLING THE ROTARY SPEED STABILITY OF A DRILL BIT notes "because the drill collar assembly is very stiff against torsional strain there is practically no speed difference between (the drill collars) and the drill-bit."

The same cannot, however, be said for the drill pipe string, which typically comprises the greater part of the total length of a drilling assembly and which stretches between the surface of the Earth and the drill collar sub assembly. drill-pipe is highly flexible and exhibits torsional harmonic vibration, or oscillatory behavior.

Drill pipe behavior under torsion is unarguably complex; DOMINICK, U.S. Pat. No. 6,065,332, METHOD AND APPARATUS FOR SENSING AND DISPLAYING TORSIONAL VIBRATION, offers a concise explanation of drill-pipe behavior and the forces acting thereon:

> "During drilling operations, a drillstring is subjected to axial, lateral, and torsional loads stemming from a variety of sources. In the context of a rotating drillstring, torsional loads are imparted to the drillstring by the rotary table, which rotates the drillstring, and by the interference between the drillstring and the wellbore. Axial loads act on the drillstring as a result of the successive impacts of the drill bit on the cutting face, and as a result of the irregular feed rate of the drillstring by the driller. The result of this multitude of forces applied to the drillstring is a plurality of vibrations introduced into the drillstring. The particular mode of vibration will depend on the type of load applied. For example, variations in the torque applied to the drillstring will result in a torsional vibration of the drillstring.
>
> At the surface, torsional vibration in the drillstring appears as regular, periodic cycling of the rotary table torque. The torsional oscillations usually occur at a frequency that is close to a fundamental torsional mode of the drillstring, which depends primarily on the drill pipe length and size, and the mass of the bottom hole assembly. (BHA)"

When it is considered that any drilling assembly has multiple vibration inducing variables acting thereon it is unsurprising that reservations were expressed as to the ability of the McLOUGHLIN communications method to adapt to a wide variety of drilling scenarios. However the simple observation behind this patent concept was that if, at the surface of the earth, a million revolutions are input into the drillstring and subsequently a million revolutions are not delivered to the distal end of the drilling assembly, then communications will not be the issue—there will be more pressing problems with the drilling assembly. Largely then, the effectiveness of this method of communications protocol is determined by 'when' the revolutions which are input at the surface of the earth are delivered to devices located at the distal end of the drilling assembly, i.e. timing.

In view of the novelty of the communications format, the lack of field experience and the criticality of the application, it was determined that optimal chances of success would occur if data sets were separated, one from the other by "null" data sets, otherwise referred to as "data-gaps". Gaps were defined by reducing the drilling RPM substantially, either to zero, i.e. non-drilling or below a rotational threshold speed at which drilling would be severely compromised. In practical applications of this patent, all communications protocols were designed with 'null' interpolation as illustrated in FIGS. 3A and 3B of U.S. Pat. No. 6,847,304. This format is still in use today.

Despite successes with the McLOUGHLIN method of rotary communications, this approach, as with earlier devices, leaves the drilling process compromised as rotation has to stop on at least one occasion per data (point) transmission sequence or "data set" in order to provide a baseline or relational marker for the data transmission to occur.

With all the examples of prior art cited herein, it is evident that a more sophisticated or detailed data downlink will result in a longer transmission time with a corresponding increase in the potential for data corruption or transmission failure between the surface and the distal components located in the bottom hole assembly. The instant method and system proposes an improved methodology for increasing the range of data transmitted from the surface of the earth to sensors located at the distal component of the drilling assembly without increasing the risk of transmitting corrupted data.

The McLoughlin prior art considered that microprocessor speeds were sufficient to overcome the limitations in earlier devices and that the actual drillstring RPM could be monitored by sensors which had higher data acquisition rates than had been available in the past, such that the actual instantaneous RPM could be monitored and used as an integer in the transmission of data to the downhole location.

Field experience of this mechanism and methodology proved that the microprocessor speed was sufficient to keep up with drillstring RPM in excess of 300 RPM. Field experience also proved that, even with severe stick-slip, the device was capable of transmitting RPM to a very small window of accuracy, such that the required toolface accuracy could be transmitted within less than 3° tolerance, corresponding to an ability to read within +/−2 RPM. In field trials and in commercial deployment, this format, incorporating null data blocks was always used, typically with a reported 2σ or 95% first time success ratio.

The mechanism was also able to compensate for stick-slip by monitoring real-time revolutions such that the revolutions were measured against a time baseline and averaged over a given, pre-determined period. Given the requirement for absolute certainty in the application of three-dimensional direction trajectory control, a preamble was added to the transmission sequence to ensure that no command sequences were inadvertently transmitted to the downhole device.

The invention was limited in scope as the preferred downhole target device was a non-rotating stabilizer specified in McLOUGHLIN et al U.S. Pat. No. 5,979,570 SURFACE CONTROLLED WELLBORE STEERING TOOL and further in U.S. Pat. No. 6,808,027, WELLBORE DIRECTIONAL STEERING TOOL. This constrained the practical application of U.S. Pat. No 6,847,304, as its application was limited to devices which had non-rotating sleeve characteristics. The device was, additionally, constrained in that it was unidirectional in nature and did not contemplate confirmation of the transmission receipt from the downhole device. The lack of a confirmation response meant that the talkdown protocol had to be infallible in order to gain commercial acceptance. The critical requirement for absolute certainty of data transfer from the surface location to downhole meant that sample times were extended which provided constraints to the economic viability of the method and device in terms of the amount of data or data density which could effectively be transmitted from the surface of the earth to the downhole device.

Prior art, individually and collectively, thus envisaged simple, single phase, transmissions, incorporating periods of 'zero' rotation, even when frequency modulation was contemplated.

Thus, there remains a need to provide an adaptive system to communicate with devices located at the distal end of the drilling assembly that is devoid of "zero" rotation time periods and effective when stick-slip and other complications in the drilling process are present.

SUMMARY OF THE INVENTION

The instant invention seeks to mitigate and avoid the problems described above through the use of an adaptive protocol which is an object of the instant method. At a minimum the instant method proposes an adaptive system of communicating information from the surface of the earth to a device located downhole. A further object of the invention is the optimization of the drilling process as the talkdown protocol will adaptively fit around the existing drillstring RPM. A further economic benefit is that with this adaptive system the ΔRPM Offset between the optimized drilling condition and the RPM required for data transmission can be monitored and adjusted in real-time, resulting in less disruption to the drilling process. This, effectively, constitutes real-time downhole calibration.

Prior art did not allow for adaptive program sequences to be transmitted from a surface to a downhole location, whereas the instant device considers that the ability to work from a variable baseline which is related to optimal drilling RPM and which is established and quantified in real-time is a fundamental improvement to the "talkdown" process. For example, a bit may drill a certain formation more effectively at a particular RPM range; thus alterations in the formation being drilled may result in a requirement to alter the RPM many times in the course of a single bit trip in order to (re)optimize the drilling process, indeed, it may be altered within the time or distance drilled within a single joint of drillpipe. The instant method and device is therefore adaptable to work from a baseline which is variable and which is configured in real-time either from information gained from instrumentation which is rotationally co-located within the bottom-hole-assembly ("BHA") and which is transmitted back to surface, or from observation of surface RPM input without additional data transmission from downhole devices and without the need to arrest the drilling process to create a new baseline. Thus, the instant method can be integrated with existing downhole technologies or may act as a stand-alone method of communicating with any downhole device.

Additionally, the instant invention considers that surface to downhole transmissions which are adaptive is a desirable and important feature of the instant art form. That is to say that in addition to being able to utilize a baseline or datum RPM which is variable in furtherance of optimized drilling parameters, the duration (timing) and offset (ΔRPM) are themselves adaptively variable. Knowing that drilling parameters and in particular RPM, may be altered for a variety of reasons and at many times during the well drilling process and considering that drilling parameters are optimized for economic reasons, it is desirable to minimize the "delta offset" (ΔRPM) which is used in transferring information from the surface to the bottom of the borehole as any delta RPM offset (ΔRPM) corresponds to adoption of sub-optimal drilling parameters. It is also desirable to minimizing the time taken to transmit data sequences to a downhole device, as this results in the potential for greater surface to downhole transmission data density.

The instant device and method contemplates an adaptive way of arranging rotary command sequences to obtain optimal encoding with minimal disruption to the drilling process. Within the scope of this method it is possible to incorporate single-phase, bi-phase, or, for preference, multi-phase data transmission, subject to the requirements of the particular well profile, surface and downhole tool configurations and required data transmission density.

An important element of the invention is a significant increase in the data density which can be transmitted to the downhole device using this equipment and methodology when compared to prior devices. The result is superior communications between surface the surface of the earth and downhole device(s), with the potential for a more integrated and adaptive approach between the surface and downhole sub-systems. Indeed, it is envisioned that the versatility of this adaptive protocol would enable multiple downhole devices, co-located within a single drillstring to receive information, data or commands, in a timely manner, without compromising the efficiency of the drilling process.

Additionally, the instant method provides a viable possibility of surface to downhole transmission of real-time depth which is of incalculable value in drilling complex well profiles as it allows trajectories to be preprogrammed into downhole tools which can then be acted upon once the required depth is achieved. This allows sophisticated adjustments to be made to the wellbore trajectory without additional intervention from surface.

Other data to be transmitted may include instructions to a downhole device on alterations to its internal configuration or geological or other marker bed information or any other piece of information which is of practical use to downhole devices. Thus, the instant method and device may be used to adapt any downhole device or devices to changing requirements of the drilling environment and instruct about events which pertain to its/their internal mechanisms, or to convey information pertaining to the external environment which are outside the measurement ability of downhole sensors and thus enhance the capabilities and economic effectiveness of existing devices. Data may be quantitative, or qualitative in nature.

Therefore, this method will allow almost continuous transmission of information between the surface of the earth and the downhole drilling device, with very few additional mechanical or electro-mechanical components being required and with minimal alteration to the selected ideal drilling parameters. As a further economic benefit, it is possible to configure existing downhole systems which are equipped with the appropriate sensors to receive information by adding software protocols which can decode the information which is being transmitted, for example downhole instrumentation telemetry packages.

A further benefit which accrues if existing downhole telemetry package sensors are utilized is the ability to obtain confirmation of receipt of transmission from existing MWD/LWD downhole components in the form of pulse telemetered messages. In this way the adaptive protocol may be optimized during the drilling process without loss of drilling time. If the MWD/LWD components also telemeter quality of transmission the time taken for subsequent data transmission frames will be optimized in terms of duration and offset as the particular well environment is assimilated and acted upon Although, as practical field application of the McLoughlin Patent (U.S. Pat. No. 6,847,304) proved, it is possible to pass rotary command sequences from surface by manually altering the rotary speed of the drillstring, for ease of use and practical applicability, the instant patent proposes the use of a software controlled hardware interface between the operator and the surface rotational motive means of the drillstring, although any suitable interface may be used without departing from the spirit of the invention Thus, a more sophisticated adaptation of the proposed method and apparatus would integrate a surface control system with the rotary drillstring motive means. By this method, human error is removed from the physical downlink protocol. The apparatus would, ideally, comprise an electromechanical interface between operator and the drillstring, which would have the ability to control the rotational speed, ΔRPM offset of the drillstring rotational speed and duration of maintaining the offset. It is within the objects of this patent to substitute different surface RPM control means while remaining within the scope of this patent.

The interface can be used whether the rotary motive means is a topdrive or a more conventional rotary table.

BRIEF DESCRIPTION OF THE DRAWINGS

FIG. 1 shows a schematic of a downhole sensor showing idealized rotary speed output at the distal end of a drilling assembly.

FIG. 2 shows a more typical downhole sensor output, depicting uneven rotary speed typical seen drilling

FIG. 5 shows a simple encoding sequence for transmission of large amounts of data from the surface of the earth to a downhole device illustratively using three contiguous hexadecimal data frames.

FIG. 9 shows a preferred schema for encoding information where the position of the numerical values of data to be transmitted are varied within their data frames in accordance with pre-determined, yet adaptive, protocols.

DETAILED DESCRIPTION OF THE EMBODIMENTS

Figure 3:
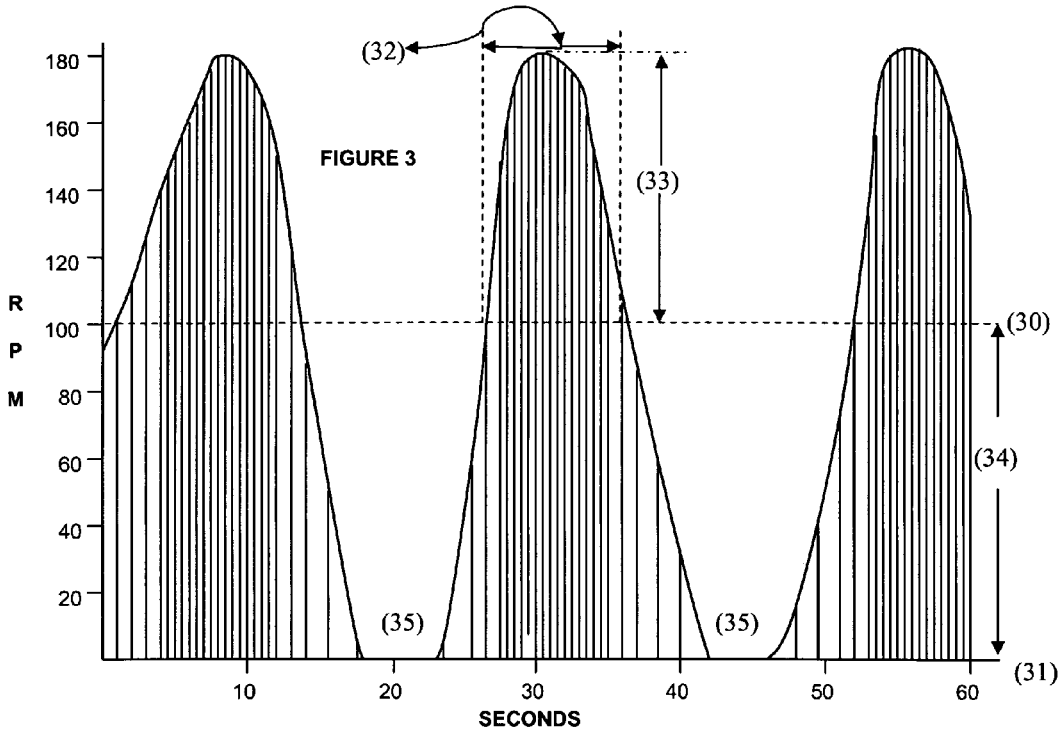
FIG. 3 shows downhole sensor outputs when more severe stick-slip is present

In one embodiment the device constitutes a surface computer equipped with an interface to the drilling rig rotary drive which contains information for encryption and transmission to the downhole instrumentation package. Any downhole device which is to receive information is equipped with a similar decryption program protocol to facilitate effective transfer of information between the surface location and the downhole device or devices. The surface computer monitors the existing baseline drillstring rotational speed in order to establish a datum from which to modulate the rotational frequency in order to encode the information to be transmitted. The program variables' sophistication, including timing and ΔRPM offsets are variable and adaptive, depending on the application, information to be transmitted and specific well environment and requirements. The surface computer is equipped with a real time clock interface which during program sequencing causes the mechanical interface to temporarily override the existing baseline rotational speed being input into the drillstring within pre-determined yet adaptable time limits. The over-ride, or ΔRPM offset, may be positive, representing an increase in drillstring rotary speed, or negative, representing a decrease in drillstring rotary speed.

The surface control of the drillstring rotation incorporates not only RPM control, but "ramp" profiles, i.e. the speed with which RPM is gained and lost from the drillstring, alternatively expressed as drillstring rotational acceleration and deceleration.

The management of the "ramp-profiles" forms an additional means of transmitting information, whereby the slope of gain, meaning the increase in RPM per n time period and conversely the slope of RPM loss, meaning the decrease in RPM per n time period may in and of themselves constitute a segment of the information to be transferred, or, alternatively may comprise a differentiator between different types of data to be transmitted to components located at the distal end of the drillstring.

Such computer controlled surface assemblies are functionally desirable as they constrain drillstring acceleration and deceleration within acceptable limits. drillstring wear is exacerbated when rapid acceleration and deceleration are present.

In addition, the simplicity of the surface system hardware and versatility of the surface system software allows for more accurate timing of events and for error free adjustment of the protocol timing as required.

It is another object of the present invention to provide an adaptive system which can compare the observed surface drilling condition with the reported downhole drilling condition.

In one embodiment of the present invention, synchronization of the surface and downhole devices is accomplished by simple comparison such that when a pre-determined and absolute number of drillstring RPM have been input at surface and received downhole, both surface and downhole instrumentation are taken to be zeroed. For example, following a connection in the drilling process, the pumps are turned on and the rotary speed is increased from stationary to a desired number of RPM. In a preferred embodiment of the device and in compliance with standard drilling practices the addition of a length of drillpipe provides an evident starting point for a bi-directional communications protocol, although the communications protocol may be started at any other appropriate point in time. In order to add a length of drillpipe, the drilling pumps have to be switched off, flow is reduced to zero, internal drillpipe pressure is reduced to hydrostatic pressure and, typically the rotary table has to remain stationary for a period of time. This sequence of events is easily tracked by downhole devices and used as a convenient marker for subsequent events. Following the addition of an additional length of drillpipe, it is usual to take a directional survey in order to ascertain the latest position and directional tendencies of the wellbore. Recently, this has also become common practice on vertical wells and is therefore an appropriate starting point for synchronizing surface and downhole systems on the majority of wells.

Directional surveying is typically accomplished by MWD survey techniques. Prior to the MWD transmission the pumps are switched on. Immediately following the MWD directional transmission, the bit is placed back on bottom and drilling re-commences. At surface, when, for example, 100 revolutions of the drillstring have been made or any number which is easily detected using one of a variety of well understood methods, the surface system clock and the downhole instrumentation clock(s) are zeroed. All timing inputs until the next period when the drillstring rotation stops are now referenced to this point in time. In a similar manner, the downhole tool detects 100 revolutions of the drillstring in a manner which is easily understood, using one or more of a variety of commercially available sensors and its internal clock mechanism is likewise zeroed. It can be easily understood that, although there are slight timing variations between surface input of RPM and downhole output of RPM that these differences are minimal when considered in a contextual timeframe.

To facilitate the mud-pulse telemetry transmission of downhole rotational characteristics, the downhole angular acceleration or vibration is monitored by sensors which are located within and comprise a standard component of the downhole MWD device as previously described.

That is to say, in order to proceed with the instant method with minimal disruption to the drilling process, an ideal method for any communication cycle may proceed as follows:

(a) Establish normal MWD directional communications in accordance with standard industry protocol (b) Re-establish normal drilling operations, incorporating flow, RPM and weight on bit.

(c) Optionally transmit via MWD, measurements pertaining to the distal rotational characteristics of the drillstring, as previously indicated, (preferably post transmission of the full survey directional data) in a time frame which will allow the cyclic pattern of drillstring harmonic vibration under existing drilling conditions to become established, (d) Optionally, receive the information transmitted in (c) above at surface and adapt the surface to downhole telemetry as required.

(e) Transmit information from the surface of the earth to a downhole location in an optimized format which is compatible with the observed conditions downhole, pre-programmed data, information and protocols to components co-located at the distal end of the drilling assembly (f) Optionally transmit modified information from the surface of the earth to a downhole location in an optimized format, as specified in (e), above, and which takes into account information derived from the optional downhole feedback mechanism examined in (c) and (d), above.

The above mentioned schema comprises a preferred method of operating the downhole adaptive section of the device and method which largely complies with standard operational procedures, but is not intended as a constraint on the scope of the invention.

Any appropriate sensor can be utilized in order to measure revolutions of the drillstring in the downhole environment. However, as no direct azimuthal or vector rotational measurements are required and the entire sensor requirement is to be able to detect rotation, a simple, inexpensive sensor type should suffice. (This could include MEMS type sensors.) Thus at the distal end of the drilling assembly, the nominal surface input RPM may be directly measured by counting discrete RPM events over a given time period, may be calculated from vibration data or, alternatively, may be a contained within a message sent from surface using the instant protocol.

In the case of direct measurement, measurements are taken as required in order to derive a point of peak amplitude which corresponds to a defined point in a single rotation. It is evident that the high side of the hole, or, is preferable as circumferential a markers, however any appropriate point or points may be utilized. In near vertical wells where it is difficult to define "high-side" it is common, to magnetometer as a measurement device, using magnetic north as an identifiable indexing point. Unlike traditional survey applications where quantitative sensor data output is required, in this instance only qualitative data is required, referenced to a downhole clock timing circuit. For preference, peak samples are obtained. Raw sample data may be averaged and filtered to provide an output curve. Even with vibrational interference rotation monitoring and RPM "centering" will be possible. There follows an illustration of sample timing as measured against potential peak RPM:

Where RPM=300 drillstring RPM=5 Revolutions per second.

Sampling at 256 samples/sec=51.2 Samples/Revolution

Detecting an arc of 30°, i.e. 15° either side of a known peak point.

This is easily within the scope of sample range provided by existing downhole technologies.

Figure 4:
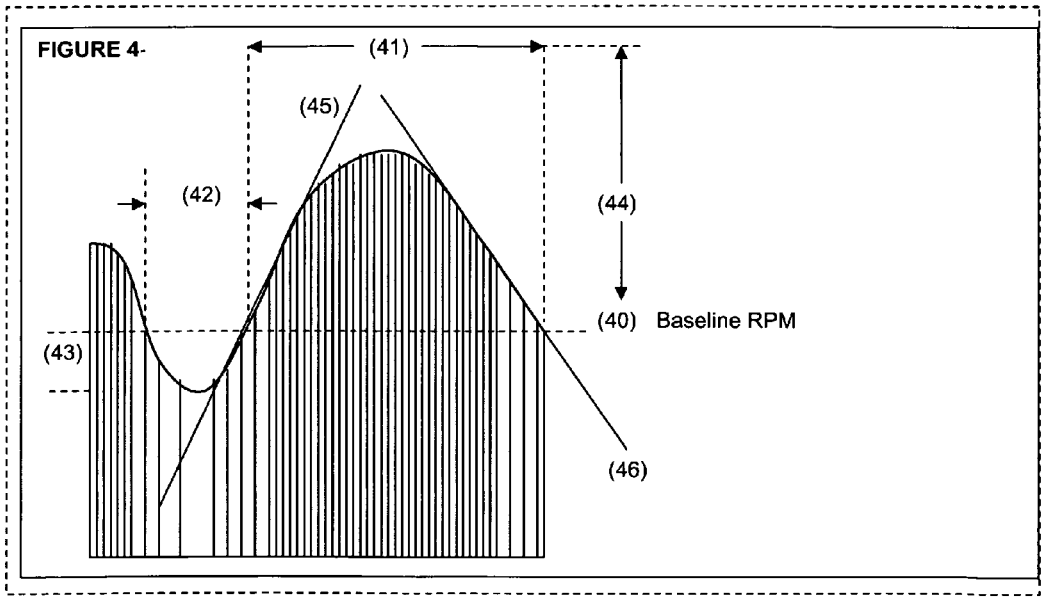
FIG. 4 shows a focused view of a stick-slip outputs and points of interest for transmission back to the surface of the earth.

The downhole device is equipped with memory in which to store the peak measurements of each sensor which are of interest [See FIG. 4.] This part of the memory may be translated into encoded data for transmission to surface via conventional mud pulse telemetry, or wireline, or any other means such as via a specially modified drillstring.

The sensor outputs are then logged against time to indicate relevant features of the downhole baseline rotational speed, thereby creating a profile against which to measure ΔRPM offsets. In an idealized transmission, stick-slip would play a minimal or non-existent part in the communication protocol. In a preferred mode of operation, once the existing downhole environment is reported back by MWD telemetry, the surface system may adaptively transmit data by a protocol which gives the best possibility of successful data transmission. The optimal transmission timing is one which provides the highest degree of certainty of a successful transmission combined with the shortest transmission time.

FIGS. 1 through to 4 illustrate some of the rotational characteristics which are likely to be observed by sensors located at the distal end of the drilling assembly. FIG. 1 illustrates a diagrammatic embodiment of downhole records for one minute of idealized drilling conditions at 120 RPM, where there would be 120 revolutions registered in memory at precisely 0.5 second intervals. The reader is referred to FIG. 1. This represents a schematic of the downhole sensor measurement of RPM. Peak amplitude of a sensor output is represented by the horizontal line marked (11). Each individual vertical line represents a single rotation of the drillstring (12). Traditionally "high" side of the borehole will be selected as an identifiable indexing point from which to reference sensor orientation, but any other index point, relating to either the wellbore or the orientation of the instrumentation itself, may be used with equal utility. It should be noted that the RPM timing in this idealized sequence shows the index point of each revolution occurring at exactly equal time intervals. In this example the frequency of the measured index points are 2.0 Hz.

FIG. 2 illustrates a similar, but suboptimal example where the 120 RPM will "arrive" at the downhole location at unequal times: in an extreme example the drillstring acceleration may result in the total RPM count momentarily exceeding 120 RPM. drillstring peak amplitude (21) is labeled as is the lower marker (22). The sum total of revolutions per period is identical between surface and downhole, thus, for every increase above baseline RPM, there is an equal and corresponding decrease in RPM. The instant device is capable of differentiating the rotational transit features using any statistical means in order to derive meaningful quality of baseline RPM data.

FIG. 3 illustrates an even more extreme example of unwanted stick-slip measurements made at the distal end of the drilling assembly, where there are periods where the drillstring actually stops rotating for a period of time (35). This is followed by corresponding and proportional peak amplitude rotation increases (33) which take place over another measurable time increment (32). Surface input RPM is noted (34) and is equal to RPM Average (30).

A timeline (31) is established in seconds, against which RPM is measured. It will be observed that the peak amplitude RPM (32), defined as RPM events (33) which exceed the average RPM (30) have rotational measurements which are more closely grouped than the lower amplitude RPM (34). One component which is visible as a result of the measurements which are made is the ability to identify periods of no-rotation at the bit (35). The benefit of having this real-time information is to allow modulation of the input power from surface in order to diminish the unwanted effect of extreme stick-slip. Taking advantage of the benefit of bi-directional communications, this condition would be visible to the operator at surface. Thus the degree of severity of stick-slip will be understood and adjustments to surface RPM can be made in order to provide a less erratic baseline RPM from which to offset communications transmissions.

If the data which is received at surface indicates that the RPM Interrupt interval (35) or the RPM-Peak value [FIG. 3, (32) and (33)] are excessive and would potentially cause poor data transmission, then the surface system will modify the RPM in order to bring these values within acceptable ranges prior to commencing data transmission. Adjustments to the surface RPM may take the form of rhythmic or arrhythmic acceleration or deceleration of the drillstring in such a way that the RPM interrupt shown at FIG. 3 (35) is diminished. A further advantage of this method, known by practitioners of the art, is that reduction of the condition of stick-slip typically results in increases in drilling penetration rate and improved drilling economics.

FIG. 4 shows some of the variables which could be transmitted via MWD telemetry to surface in order to optimize the baseline RPM at the distal end of the drilling assembly. All measurements from the distal end of the drillstring are measured in relation to an average established surface baseline RPM (40) ("RPM-Avg") expressed in RPM.

Indicators of distal variations from the surface input RPM may be transmitted as indicated in FIG. 4: time between baseline to baseline peak amplitude, (41), time between baseline to baseline trough amplitude, (42), ΔRPM offset below the baseline RPM, (43), ΔRPM offset above the known baseline RPM, (44) and the slope of the ΔRPM offsets from baseline RPM (45), (46). It is within the scope of the invention to transmit the nominal surface RPM to the downhole device thus reducing the requirement to telemeter large numbers and allowing for delta offsets to be transmitted using pulse telemetry methods. It is also within the scope of this invention to make any other appropriate sensor measurements pertaining to rotation, whether of a geophysical or non-geophysical nature, however quantified, for the purposes of reducing the effect of drillstring harmonics of the distal end of the drilling assembly. These measurements may be recorded downhole, constitute raw or processed data and be encoded for transmission to surface via pulse telemetry or any other means.

Information being transmitted to surface enables real-time manual or automated decisions to be made which allows for variation of the drillstring surface input torque in order to optimize the BHA response with respect to stick-slip. Prior art, MACDONALD, U.S. Pat. No. 6,732,052, METHOD & APPARATUS FOR PREDICTION CONTROL IN DRILLING DYNAMICS USING NEURAL NETWORKS and DOMINICK, U.S. Pat. No. 6,065,332, METHOD & APPARATUS FOR SENSING AND DISPLAYING TORSIONAL VIBRATION focus on the MWD transmission of qualitative data, and surface display, typically in the form of warning flags when dangerous levels of shock, vibration, acceleration and deceleration are measured. The instant device and methodology represents an improvement over prior art as it transmits quantitative information with which to make decisions enabling effective alterations to be made to the surface drillstring torque input characteristics, with the goal of reducing unwanted drillstring harmonic vibrations.

The data transmitted from the surface is measured by sensors located within the distal component of the drillstring and is assessed for quality. The quality acceptability criteria are then transmitted to surface, where the adaptive surface system takes the appropriate measures to determine improvements to the frequency, i.e., timing and ΔRPM offset of the data set to be transmitted in order to enable the optimal data downlink quality format to be selected.

FIG. 5 illustrates a surface to data transmission format incorporating hexadecimal coding. A hexadecimal coding base constitutes a preferred transmission format as it has the advantages of creating data frames which comprise a 4×4 matrix: that is to say, each data frame is 4 time periods in length, with four potential RPM variations from the established drilling baseline within each time frame. It should be understood that any base format of encoding is within the scope of this invention. The coding base itself may be a field variable and an adaptive component of this invention.

Figure 5A:
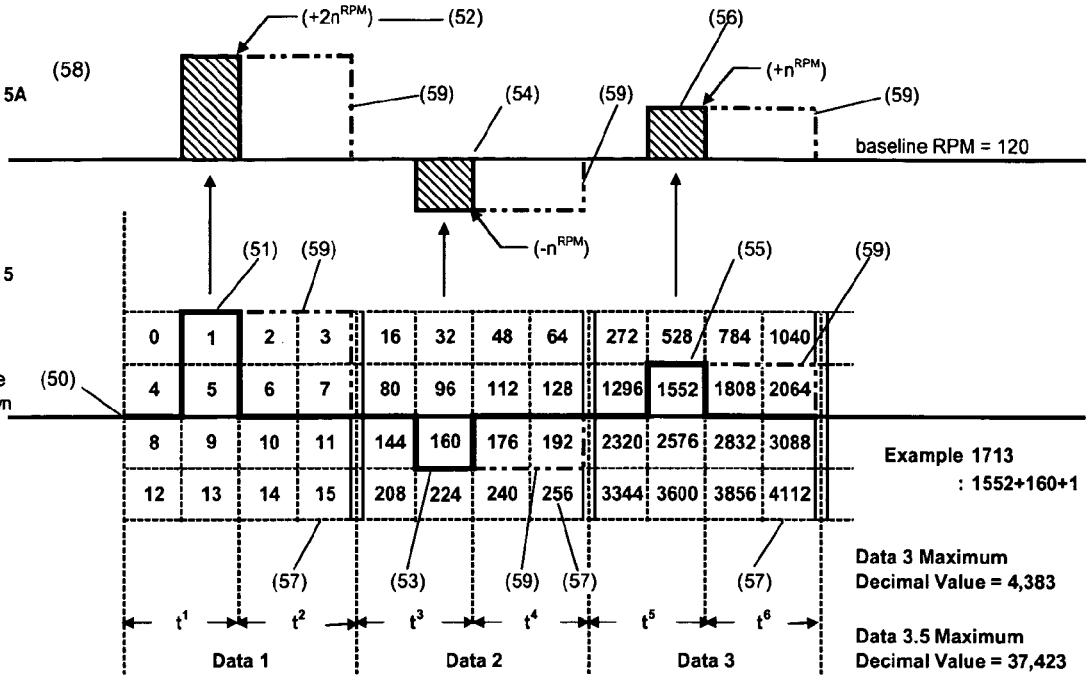
FIG. 5A shows the simple encoding sequence illustrated in FIG. 5, using three hexadecimal data sets, for simplicity, broken out into its constituent components
Figure 6:
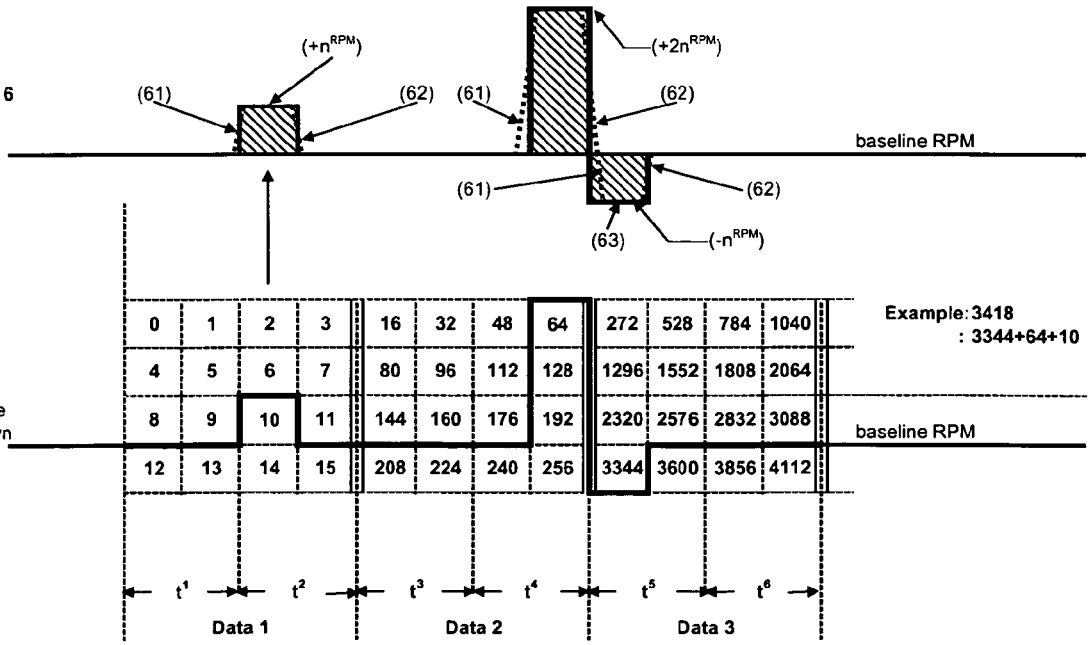
FIG. 6 shows a simple encoding sequence using three hexadecimal data frames indicating a less than optimal data transmission frame.

The data transmission examples shown in FIGS. 5, 6 and FIG. 9, which constitute a preferred embodiment of encoding, illustrate positive RPM communications shifts of +1 nRPM and +2 nRPM and negative RPM communications shifts of −1 nRPM and −2 nRPM RPM. It is envisaged that 10 RPM represents an optimum for each shift from the established baseline; thus the shifts illustrated in FIGS. 5, 6 and 9 represent deviations of +10, +20, −10 and −20 RPM from an established drilling RPM baseline. It is within the scope of this invention to utilize any delta RPM offset variation or use asymmetrical delta offsets within a single transmission frame. These figures assume that the drilling RPM—and thus drilling economics—has been optimized and that any communications variations are minimized in order to retain optimized drilling penetration rates.

The coded information may be preceded by a preamble or synchronization word which is used selectively as a data discriminator, data format identifier, identifier for a target device or initiating trigger for the data sequence. An alternate use for a preamble may be to incorporate multiple information sets within a single transmission sequence. Thus, for example, in a preamble which is to be followed by data to be transmitted to a 3D-rotary steerable system the preamble may indicate that the first data frame contains information on the degree of dogleg severity to be selected, and the second data frame contains concerning required toolface direction to be communicated. Of course, in many LWD systems there is a common system bus which obviates the need for identification of a target device, the instruction is then sent to a central "receiving" sensor located within a downhole instrument package and "forwarded" to the individual device which then takes the appropriate action.

A further method of discriminating the contents of data frames might be to increase or decrease the baseline over a specific period of time, resulting in a trapezoidal RPM variation shape, rather than the idealized square wave variation shape which is illustrated in FIG. 5 through to FIG. 9. For example, increasing the RPM over n period by ×RPM might be an indicator that the data set following the particular "ramp" profile contains a specific type of information which may then, for example, be directed to a particular downhole device or used to set in motion logical processes within devices located at the distal end of the drilling assembly.

In FIG. 5, a rotary speed baseline has been established for drilling a certain formation at 120 RPM. A timeline is included to illustrate the nature and timing of the data transmission from surface. Data in this example is to be transmitted in three (3) discrete data sets, [FIG. 5A, (52), (54), (56)] Data frame (52) contains integers 0 to 15 "n1" which occur in time intervals t1 and t2 ; subsequent data frame (54) contains integers from 16 to 256, incremented in '16's', "n16", which occur in time intervals t3 and t4 and the third and final data frame of this example (56) contains integers from 272to 4,112 incremented in 256's, "n256" which occur in time intervals t5 and t6. In this way a maximum decimal data value of 4,383 may be achieved using three complete data frame. It is feasible to add an additional half-data frame t7, (not illustrated), which would increase the transmitted number maximum to 37,423, which is ample for transmission of real-time depth to a downhole location. Addition of a further data frame t8, (also not illustrated) would increase this to 70,191. It is envisaged that the optimized transmission of data blocks t1 through to t6 will take three minutes, although in an environment which is substantially free from stick-slip this may be reduced. Thus, the instant invention constitutes an improvement over prior art in that the amount of data which may be transmitted over a specified time period is exponentially greater than the existing art and has the added benefit of not interrupting or compromising the drilling process. The data frames shown here may be arranged in any order, the ones in this example being purely for illustrative purposes. That is to say that within each data frame the numbers may be arranged differently, and the order in which they are received (n1, n16, n256) may be reversed or arranged differently from the frames shown in this figure.

The versatility of the system and method also allows for each data frame to have a different format and for multiple, semi-continuous data frames to be sequentially added, thus "preamble, n1, n16 n1, n16, n256, n1, n16 n1, n16, n256 . . . ".

The data which is to be transmitted, using the instant method may be numerical, encoded or encrypted and it may be transmitted to a single or multiple tool types within an individual drillstring.

It is within the scope of the invention to include safety, parity and error-checking blocks such that errors in data transmission are minimized. These are not explored in any detail here but are well known to those versed in the art of downhole drilling and communications.

The downlink illustrated in FIG. 5, uses hexadecimal format. The number which is being transmitted from surface is decimal '1713 and is an encoded representation of any data which it is advantageous to transmit from the surface of the earth to a downhole device'. In the preferred hexadecimal encoding format shown in this and subsequent illustrations, this equates cumulatively to 1+160+1552. Data is extracted from downhole measurements made at the points labeled (51), (53) and (55). FIG. 5A shows the idealized data transmission sequence with (52), (54), (56), representing the formulae for the data set. In this example and starting with Data set 1: a "1" is transmitted. In this illustrative example, the transmission is made by increasing the rotary speed of the drillstring by 20 RPM over the established baseline rotary speed for a pre-determined period and then returning to the baseline. The second data set transmits a "160". This is accomplished by reducing the rotary speed of the drillstring below the established baseline rotary speed by 10 RPM (53). The final data set is "1552". This is transmitted by increasing the rotary speed of the drillstring above the baseline rotary speed by a value of 10 RPM (55), (56), or, expressed differently, by increasing the RPM by 20 RPM over the baseline established at (53). It will be evident that the selected characteristics of increasing/decreasing RPM to transmit information, once established, should remain unaltered until completion of a specific data set or until a new baseline RPM is established. As previously discussed, events such as making a connection, or the transmission of a new "synchronization" word may usefully serve as data transmission boundaries. There is thus no need to trip the drillstring to surface in order to alter the downhole protocol format. Points labeled (57) indicate maximal values for specific data sets using this particular, hexadecimal, schematic.

A further variation to this schema is that within each discrete data set, once the data has been transmitted, the RPM does not return to its original baseline, but continues along the data point (51), until the end of that data set, i.e. the end of t2, t4 or t6, respectively. The advantage to this method is that the downhole processor has a longer sample time from which to sample and extract the data. At the end of t2, (58), for example, the RPM returns to the baseline. In this example, given that each data block is 1 minute in length, this would mean that the numerical value '1' is decoded from information received over a 45 second time period. This is illustrated by the heavy dashed line in FIGS. 5 and 5A (59) The 'return to zero' method is effective and self-checking, enabling continuous timing re-calibration.

FIG. 6 shows a further example where, due to the positioning of the data blocks within the matrix, there is a Δ4n offset between contiguous data sets. The decimal number which is being transmitted in this example is 3,418. The Δ4n offset occurs between the transmission of the value "64" in the second data frame and the transmission of the value "3,344" in the third data frame. Although the first Data Set has sufficient 'recovery' time to return to its baseline rotary speed, the large ΔRPM differential between the second and third Data Sets is, potentially, problematic. In the schema which is shown in FIG. 6, the proximity of the data sets within consecutive data frames, t4 and t5 in conjunction with a Δ4n offset, presents a time constraint for the length of each data frame as the RPM has to return to a baseline within a time which does not compromise sensor sample frequency or decoding of information at the distal end of the drilling assembly data. It is clear that the rotary speed acceleration and deceleration depicted in FIG. 6 are idealized. Practical field applications show acceleration and deceleration of the rotary speed taking a trapezoidal (rather than square wave) format, (61), (62) due to surface equipment and drillstring limitations. Rapid acceleration and deceleration of the rotary speed of the drillstring, particularly over large RPM offsets, is undesirable. Large delta offsets in RPM between contiguous data blocks have the effect of reducing the data sample frequency within a time frame as shown at (63). However, another advantage of the invention over prior art is that acceleration and deceleration is restricted to a narrow ΔRPM offset bandwidth, rather than the entire available range of drillpipe rotational speeds. This in turn increases the sample frequency and improves the effectiveness of a data transmission. An alternative is to extend the time frames, t1, t2, etc., however, this is undesirable as the time taken to complete data transmission is extended, resulting in diminished data transmission efficiency.

Figure 7:
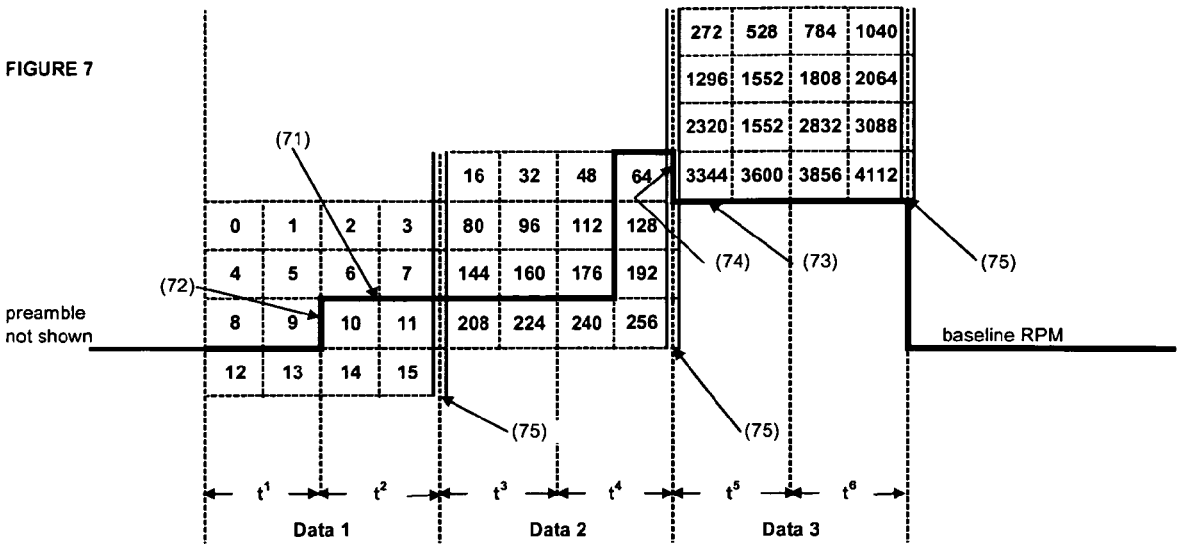
FIG. 7 shows a method of rearranging data transmission frames to optimize data transmission by continually causing the baseline of the transmission to migrate in order to mitigate large variations in ΔRPM over a short time interval.
Figure 8:
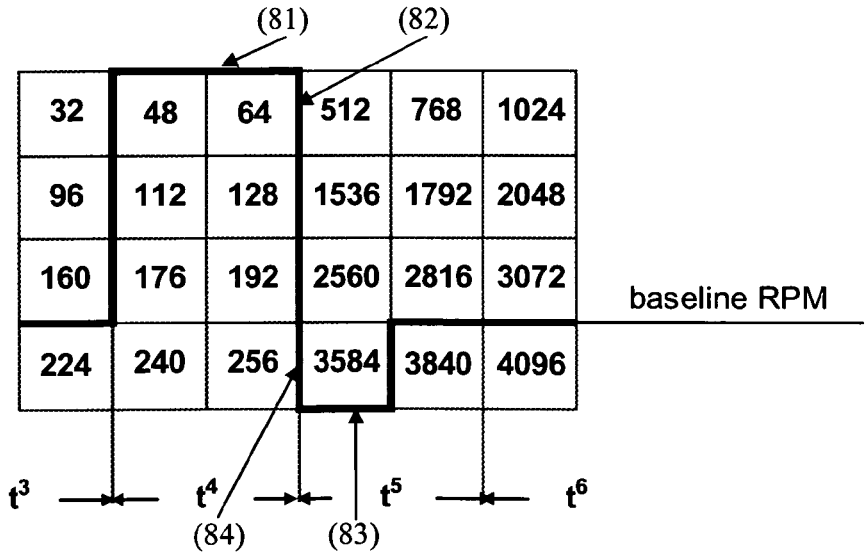
FIG. 8 shows a schema whereby block transit times are modified by extending the data frame to optimize data transmission by extending the ΔRPM offset time in order to enhance downhole sample quality.

FIG. 7 and FIG. 8 detail two potential methods for mitigation of potentially problematic rotary speed acceleration and deceleration ramps caused by large ΔRPM offsets. FIG. 7 illustrates the transmission of the same number, in FIG. 6, i.e. "3,418" as There are two key differences between FIGS. 6 and 7: firstly, in FIG. 7, the number to be transmitted is defined by the upper, (71) and left, (72), edges of the data frame in the case of a positive ΔRPM offset and by the lower, (73) and left (74), edges of the data frame in the case of a negative ΔRPM offset and secondly, the sample time is extended to the end of each data set, (75). Additionally the Δ4n offset between contiguous data sets, t4and t5, has been removed. The Δ4n offset is mitigated by re-apportioning the Δ offset to +3n and −1n and then raising the baseline of each adjoining data set incrementally. Although this does not increase the sample timeframe used for transmission of the number "64", in the second data set, the delta RPM offset between time frames t4and t5 is reduced from Δ4n to Δ1n, which reduces the criticality of drillstring acceleration and deceleration and also increases the effective RPM sample window which has a positive affects on data transmission.

It is evident that incrementing the baseline in the manner illustrated in FIG. 7, data set 2 and data set 3 should occur within the constraints of the drilling rig rotary drive. These constraints include operational maxima and minima. Thus, although the problem of large ΔRPM offsets is overcome, there is potential for this protocol format to extend beyond the effective upper range of the drilling rig rotary drive and caution should be exercised.

FIG. 8 shows the relevant portion of an alternate schema where the upper (81) and right edges (82) of the data frame are used as data defining borders. This mitigation schema occurs because, the target number '64', is at the right hand border of data set t4 which is followed by the target number '3,344' a data point occurring in the first column of the data set t5. It is clear that the number '3,344' cannot be delineated in any other fashion than to use the leading (left-hand) (84) and lower (83) edges. Wherever the ΔRPM offset is large decoding may be difficult, so a double length data set may be contrived to assist in providing quality improvements to the communications process.

Thus, according to FIG. 8, the defining 'edge' of each target number within its data set is the upper edge (81) and the right edge (82) in the case of an increasing RPM (+ΔRPM) transmission and the lower edge (83) and the left edge (84) in the case of a decreasing (−ΔRPM) RPM transmission. It is within the scope of this invention to apply any other variation of RPM boundary definition to the data transmission with the object of increasing the probability of successful data transmission. In case of transmissions which occur in an extreme, "noisy", environment, the timing windows can be increased.

This would be accomplished adaptively and without the need to trip the BHA for reprogramming of downhole elements of the drillstring.

FIG. 9 shows a further variation and preferred method for adapting the data sets to optimize transmission success. This Figure takes, as an example, the standard data format depicted in FIG. 5 through to FIG. 8, although the number of data sets may greater or lesser, dependent upon the data to be downlinked. FIG. 9 illustrates the transmission number "3,542".

In FIG. 9A, the number 3,542 corresponds to the highlighted blocks: data set 1="6"; data set 2="192" and data set 3="3,344".

From FIGS. 6 and 7, it was observed that the greatest potential problem area for successful data transmission occurs when there are contiguous data sets of single time period duration which are followed immediately by a ΔRPM alteration in the first time frame of the next data set. Effectively, at the distal end of the drilling assembly, this does not allow sufficient stabilized RPM data acquisition time while also guaranteeing effective transmission. FIG. 9A illustrates one such potentially sub-optimal data transmission: in this example, the problem area occurs at the boundary condition between data set 2 and data set 3, (91) where there are ΔRPM alterations of short duration in quick succession.

A means of altering the data set format, without increasing its duration is required and in FIG. 9B, the numbers in the center data set ("n2") have been rotated 90° clockwise ("CW"), with all the numbers retaining the same position in their grid, relative to each other, but, having moved clockwise relative to the baseline RPM. This schema is also unsatisfactory because it leaves the second data point with only a small sample time, i.e. the first half of a single time frame (t3) to adjust from the baseline to −2 nRPM. As noted previously, this may result in ineffective data transmission.

FIG. 9C, however, shows the number n2 data set rotated 90° anti-clockwise ("ACW") with the result that data in all three data sets now comprises two time periods within each data set. This provides for a longer period of ΔRPM offset, greater downhole sensor sample time and a higher degree of certainty of successful transmission than in the previous examples.

Irrespective of the number which is to be selected from within any data set, utilizing this method of rotating the numbers within the data sets always yields frame formats where the ΔRPM offset and downhole sample time are at least a half-data set or two time periods in length. Indicators of numerical rotation, e.g. Data Set 1:ACW, Data Set 2: CW, Data Set 3: Normal (not illustrated) may be contained in preamble messages or in acceleration or deceleration ramp profiles as previously discussed.

The transmission format illustrated in FIG. 9 and prior figures is indicative of the versatility of the invention, but it should be appreciated that these Figures represent a preferred embodiment of the invention and are not intended to limit either its scope or application.

Figure 10:
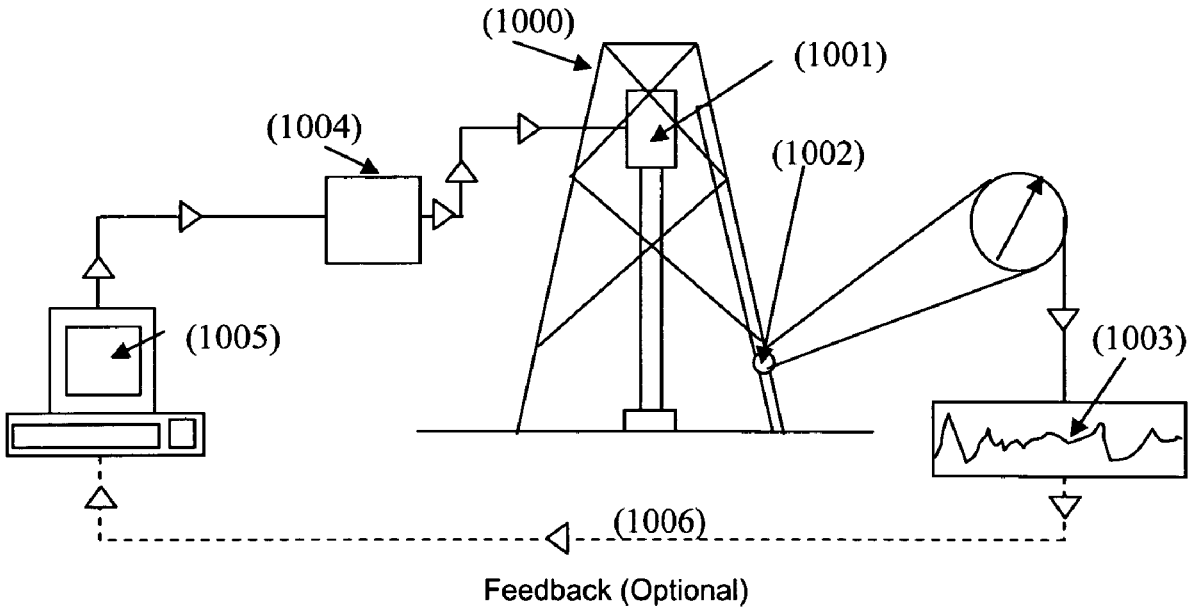
FIG. 10 shows a schematic illustrating a potential surface control system for insertion into a conventional drilling rig assembly including optional pulse telemetry feedback loop.

FIG. 10 is a diagrammatic representation of a preferred embodiment of the surface control apparatus and system of the invention incorporating a feedback mechanism from the distal end of the drilling assembly. A drilling mast (1000) or derrick which is equipped with a surface rotary motive drive for conveying torque from the surface of the earth (1001) to a drillstring which penetrates the surface of the earth [Not shown]. The drilling rig is equipped with pumping equipment and means for measuring, at surface, the pressure in the internal diameter of the drilling assembly (1002). Data is transmitted using pressure pulse telemetry from device(s) located at the distal end of the drilling assembly and pressure fluctuations which are expressly created thereby (1003) are translated into information at the surface location. The preferred embodiment of the instant apparatus and system contains at a minimum an over-ride mechanism for controlling the rotational velocity of the drillstring, (1004), in compliance with a pre-determined, but adaptive timing sequence. This comprises an electro-mechanical or mechanical or electronic or pneumatic linkage to over-ride the traditional rotary motive means controller of the drilling assembly (1004). The type of linkage is determined by the ease of interface between it and the existing drilling rotary motive means. (1001). (1000). For preference and in order to achieve the degree of sophistication of which this invention is capable, the rotary control motive means override mechanism is controlled by a computer. In this way the magnitude and duration of the rotary control communications may be precisely timed and human error removed from any communications sequence. Although, in order to accommodate the effective transfer of relatively large or complex amounts of data it is preferable to have automatic adjustment of the input surface RPM values it is not outside the scope of this invention to accomplish this manually, should this be required. In order to attain the maximum success rate of surface to downhole communications successes a link (1006) from the pulse telemetered data (1003) to the surface computer (1005) may be created. This link allows for processing of information which is transmitted by real-time pulse telemetry and creates an effective real-time feedback loop whereby communications with downhole device(s) may be optimized through having a complete understanding of the downhole environment.

Yet a further advantage of the system and method is the ability to interchange "master-slave" status between surface and downhole computers. This allows for intelligent development of downhole devices through the use of interactive logic systems. Prior art in this field typically assumes that system over-rides are limited to simple switches which are surface derived and that the downhole device only acts in relation to operator instructions received from the surface of the earth. The instant method allows for adaptive protocols where the downhole device can react to an observed downhole condition and, where a telemetry device is in place, communicate its intentions back to the surface of the wellbore.

We claim:

1. A method for delivering information from a surface location on the earth via a rotary drilling assembly to a downhole location or device utilizing drillstring modulation in accordance with pre-defined adaptive rules of transmission, the method comprising;

rotating the drillstring by motive means located on the surface of the earth, measuring rotary motion of the drillstring at surface, establishing optimal drilling rotary speed at surface then modulating the surface rotary speed in order to effect transmission of information to the downhole location or device, modifying drilling rotary speed at surface in order to optimize the environment for rotary communications such that harmonic vibrations of the drilling assembly are thereby diminished, identifying optimal rotary speed offset values for surface to downhole information transfer giving due consideration to limitations inherent in surface rotational, downhole equipment and the quality of downhole rotary motion, identifying the optimal timing for surface to downhole information data sets giving due consideration to limitations inherent in surface rotational equipment, downhole equipment and the quality of downhole rotary motion, and encoding information and selecting the appropriate format such that the information to be transmitted will be optimally received by any downhole device which is monitoring downhole drillstring rotation.

2. The method of claim 1 where an interface to the drilling rig rotary drive is provided, said interface being equipped with monitoring, control and logic means for controlling the rotary speed output of the rotary drive.

3. The method of claim 2 where said interface is manual.

4. The method of claim 2 where said interface is automated.

5. The method of claim 2 where said interface is computer controlled.

6. The method of claim 5 whereby said computer may contain comparative elements of surface rotary motion and downhole rotary drillstring attributes incorporating time phase shifts as determined.

7. The method of claim 2 wherein said method becomes adaptive by using time based information pertaining to measurements of surface drillstring parameters incorporated at the surface, for application to drillstring modulation in furtherance of frequency modulation communications optimization.

8. The method of claim 6 whereby said information may include any of, measurement of sensor output, acquisition, storage and retrieval of data.

9. The method of claim 6 whereby said information may be updated, manually or automatically.

10. The method of claim 6 whereby said information may contain the attributes of the drillstring at surface and downhole as measured in relation to time or to depth.

11. The method of claim 1 whereby downhole measurements are made of the rotary speed of the distal component of the drillstring.

12. The method of claim 2 wherein said method becomes adaptive by using time based information pertaining to measurements of downhole parameters made at the distal end of the drilling assembly, whether raw, processed or encoded data transmitted back to surface by pulse telemetry or other suitable means is incorporated at surface for subsequent application to drillstring modulation in furtherance of frequency modulation communications optimization.

13. The method of claim 12 whereby incorporation may include any of, measurement of sensor output, acquisition, storage and retrieval of data.

14. The method of claim 12 whereby the information may be updated.

15. The method of claim 12 whereby the information may contain the attributes of the drillstring at surface and downhole as measured in relation to time or to depth.

16. The method of claim 7 where a library of information pertaining to drilling conditions is stored in a surface system, such information relating to a well specific or non-well specific database of measurements, information, commands and instructions.

17. The method of claim 12 where a library of information pertaining to drilling conditions is stored in a surface system, such information relating to a well specific or non-well specific database of measurements, information, commands and instructions.

18. The method of claim 11 whereby said downhole measurements are further made of vibration or linear acceleration and may be raw, pre-processed or encoded data.

19. The method of claim 11 where said downhole measurements are stored in downhole memory.

20. The method of claim 11 whereby said downhole measurements are transmitted from a downhole location to an apparatus or sensor located at the surface of the earth.

21. The method of claim 20 further affirming that information which has been transmitted from surface by rotary drillstring modulation has been decoded at the distal end of the drilling assembly, such confirmation being either encoded, qualitative, quantitative, or forming a recommendation that alterations are made to future surface to downhole transmission protocol.

22. The method of claim 11 where the downhole software sequences including preambles and reference frames are receptive to adaptive communications protocols which are variable in time, baseline rotary drilling speed, and offset therefrom.

23. The method according to claim 1 where rotary modulation encoded information is received and decoded downhole, effecting a transfer of encoded information from the surface of the earth to a downhole location, where such data may be stored for future usage, used instantaneously, informative, empirical, qualitative, an actuation instruction for a downhole device, a trigger for actuation of a downhole device.

24. The downhole method of claim 1 where pump cycling may act as an additional toggle or state switching step in the communication sequence.

25. The method of claim 1 where the downhole monitoring of drillstring rotation includes the ability of a downhole device to subtract cyclically induced drilling abnormalities and drilling harmonics from downlinked rotary drilling parameters so as to be able to establish an accurate baseline for the downlink transmission sequence.

26. The downhole method, according to claim 1, of utilizing information transferred from the surface of the earth to any downhole instrument, mechanism or location as a means of actuating, altering state, toggling, switching or otherwise altering an operational state.

27. An apparatus for delivering information from a surface location on the earth via a rotary drilling assembly to a downhole location or device utilizing drillstring modulation in accordance with pre-defined but adaptive rules of transmission either integrated into or external to the existing drillstring surface rotary motion drive wherein an interface to the drilling rig rotary drive is provided, said interface being equipped with monitoring, control and logic means for controlling the rotary speed output of the rotary drive and utilizing a method comprising;

rotating the drillstring by motive means located on the surface of the earth, measuring rotary motion of the drillstring at surface, establishing optimal drilling rotary speed at surface then modulating the surface rotary speed in order to effect transmission of information to the downhole location or device, modifying drilling rotary speed at surface in order to optimize the environment for rotary communications such that harmonic vibrations of the drilling assembly are diminished thereby, identifying optimal rotary speed offset values for surface to downhole information transfer giving due consideration to limitations inherent in surface rotational, downhole equipment and the quality of downhole rotary motion, identifying the optimal timing for surface to downhole information data sets giving due consideration to limitations inherent in surface rotational equipment, downhole equipment and the quality of downhole rotary motion, and encoding information and selecting the appropriate format such that the information to be transmitted will be optimally received by any downhole device which is monitoring downhole drillstring rotation.

28. The apparatus claim 27 where a surface interface to the drilling rig rotary drive is provided, said interface being equipped with means for monitoring, measuring and providing input control to the rotary speed output of the surface rotary drive.

29. The apparatus of claim 28 where said surface interface is manual.

30. The apparatus of claim 28 where said surface interface may preferentially be electronic, electro-mechanical, electro-pneumatic or electro-hydraulic.

31. The apparatus of claim 28, whereby an adaptive library of information pertaining to drilling conditions is stored in said surface interface, such information relating to a well specific or non-well specific database of measurements, information, commands and instructions.

32. The apparatus of claim 31 whereby said library of information may be updated manually or automatically.

33. The apparatus of claim 28 where said surface interface is computer controlled and wherein said computer contains an adaptive library of functional commands.

34. The apparatus of claim 28 further having an input control and associated memory whereby said input control to the rotary speed output of the surface rotary drive is responsive to information which is stored and retrieved from said memory.

35. The downhole apparatus according to claim 27, which is located at the distal end of the drillstring and being equipped with sensors and software which are capable of identifying and measuring downhole rotary motion in any form is capable of quantifying and decoding rotary modulated communications sequences transmitted from the surface of the earth.

36. The downhole apparatus of claim 35 whereby rotational measurements made at the distal end of the drillstring are transmitted by any means back to an apparatus or sensor located at the surface of the earth.

37. The downhole apparatus of claim 35 whereby sensors capable of detecting pump pressure modulation may act as a state switching step in the communication sequence.

* * * * *